US007438283B2

(12) United States Patent
Kroll et al.

(10) Patent No.: US 7,438,283 B2
(45) Date of Patent: Oct. 21, 2008

(54) TODDLER STAIR SAFETY SYSTEM

(75) Inventors: Lori C. Kroll, Crystal Bay, MN (US); Mark W. Kroll, Crystal Bay, MN (US)

(73) Assignee: Kroll Family Trust, Crystal Bay, MN (US)

( * ) Notice: Subject to any disclaimer, the term of this patent is extended or adjusted under 35 U.S.C. 154(b) by 0 days.

(21) Appl. No.: 11/519,678

(22) Filed: Sep. 12, 2006

(65) Prior Publication Data

US 2008/0061278 A1 Mar. 13, 2008

Related U.S. Application Data

(63) Continuation-in-part of application No. 10/674,216, filed on Sep. 30, 2003.

(60) Provisional application No. 60/498,956, filed on Aug. 30, 2003.

(51) Int. Cl.
*B21F 27/00* (2006.01)

(52) U.S. Cl. ..... 256/45; 256/46

(58) Field of Classification Search ..... 256/112.5, 256/45, 46, 12.5

See application file for complete search history.

(56) References Cited

U.S. PATENT DOCUMENTS 3,005,242 A 10/1961 Roberts
3,260,553 A 7/1966 Ruhnke
4,030,255 A 6/1977 Hartman
4,556,201 A 12/1985 Turner
4,852,194 A 8/1989 Langan
4,948,100 A 8/1990 Stevens
5,076,545 A 12/1991 Bodzin
5,337,528 A 8/1994 Jaworski et al.
5,437,433 A 8/1995 Rezek
5,460,409 A 10/1995 Conner
5,533,715 A 7/1996 Dandrea
5,551,194 A 9/1996 Toomey
5,657,968 A 8/1997 Marsden
5,853,166 A 12/1998 Koza
6,209,854 B1 4/2001 Sedlack et al.
6,345,475 B1 2/2002 Flory

*Primary Examiner*—Victor MacArthur
(74) *Attorney, Agent, or Firm*—Vidas, Arrett & Steinkraus

(57) ABSTRACT

A heavy net is used with an optimally sized mesh that provides an easy gripping surface for a toddler's hands with no choking or entrapment hazards. A tension securement to a carpeted surface is provided by the use of deep-machined hook surfaces. A net is fastened to an existing banister by the use of hook and loop fasteners. A carpeted stair gripper allows objects to be attached and custom fitted to the edges of carpeted stair steps with great strength and with no tools or defacement of the stairs.

10 Claims, 13 Drawing Sheets

TODDLER STAIR SAFETY SYSTEM

CROSS-REFERENCE TO RELATED APPLICATION

This application is a continuation in part of U.S. patent application Ser. No. 10/674,216 filed on Sep. 30, 2003, which claims the benefit under 35 U.S.C. 119(e) of U.S. Provisional Patent Application No. 60/498,956 filed on Aug. 30, 2003, the full disclosures of each being incorporated by reference in their entirety.

BACKGROUND OF THE INVENTION

Each year about 3 million children in the United States alone visit emergency room departments for fall-related injuries. A major cause is falling down stairs. These falls result in more open wounds, fractures and brain injuries than all other accidents of children. Nearly one hundred children under the age of 9 die per year from falls. A major problem is going up and down stairs for toddlers. These are infants between 18 months and 4 years of age. They are old enough to be able to crawl up stairs, but not typically tall enough to be able to use the adult-height banister.

The solutions suggested to date have basically involved a lower height stair rail. For example, Roberts (U.S. Pat. No. 3,005,242) teaches a secondary railing that hangs below the primary railing. Ruhnke (U.S. Pat. No. 3,269,553) teaches the use of adjustable shelf-type hangars to adjust the height of the railing. Turner (U.S. Pat. No. 4,556,201) teaches a secondary handrail for toddlers as does Jaworski (U.S. Pat. No. 5,337,528) and Koza (U.S. Pat. No. 4,853,166) and finally Sedlack (U.S. Pat. No. 6,209,854).

Hartman (U.S. Pat. No. 4,030,255) teaches a double rail telescoping system. Stevens (U.S. Pat. No. 4,948,100) teaches a special hand railing for toddlers. Another approach is the use of an adjustable railing system. This is taught by Rezek (U.S. Pat. No. 5,437,433), Toomey (U.S. Pat. No. 5,551,194) and finally Marsden (U.S. Pat. No. 5,657,968). An interesting solution is that of Flory (U.S. Pat. No. 6,345,475) who basically teaches an obstacle course of gates on alternate sides of the stairway to prevent people from falling more than a few feet if they do stumble.

For completion one should mention some of the solutions for another safety problem. This problem involves children falling through the balusters in open stairways. This includes a panel of screens as taught by Langan (U.S. Pat. No. 4,852,194), the Railnet product (attached literature) Plexiglas sheets as taught by Bodzin (U.S. Pat. No. 5,076,545), and finally Dandrea (U.S. Pat. No. 5,533,715) which weaves rigid fabric in and out of the balusters to form a barrier for the toddlers.

Thus in spite of the need for a simple safety system to allow toddlers to more safely go up and down stairs, none exist. The ideal system would be something that can be packed in a small box for easy retail sale and transport to a home, can be installed without the use of any tools, and leave no permanent marks on the home in any way. In spite of the need for such a product none has existed to date.

SUMMARY OF THE INVENTION

The major object of this invention is the use of a heavy net with an optimally sized mesh that provides an easy gripping surface for a toddler hands with no choking or entrapment hazards. A further object of this invention is to provide a method of providing tension securement to a carpeted surface by the use of deep-machined hook surfaces.

Another object of this invention is to teach the use of fastening a net to an existing banister by the use of hook and loop fasteners. Another object of this invention is to teach the manufacture of a carpeted stair gripper, which allows objects to be attached, and custom fitted, to the edges of carpeted stair steps with great strength and with no tools or defacement of the stairs.

DETAILED DESCRIPTION OF THE DRAWINGS AND PREFERRED EMBODIMENT

Figure 1:
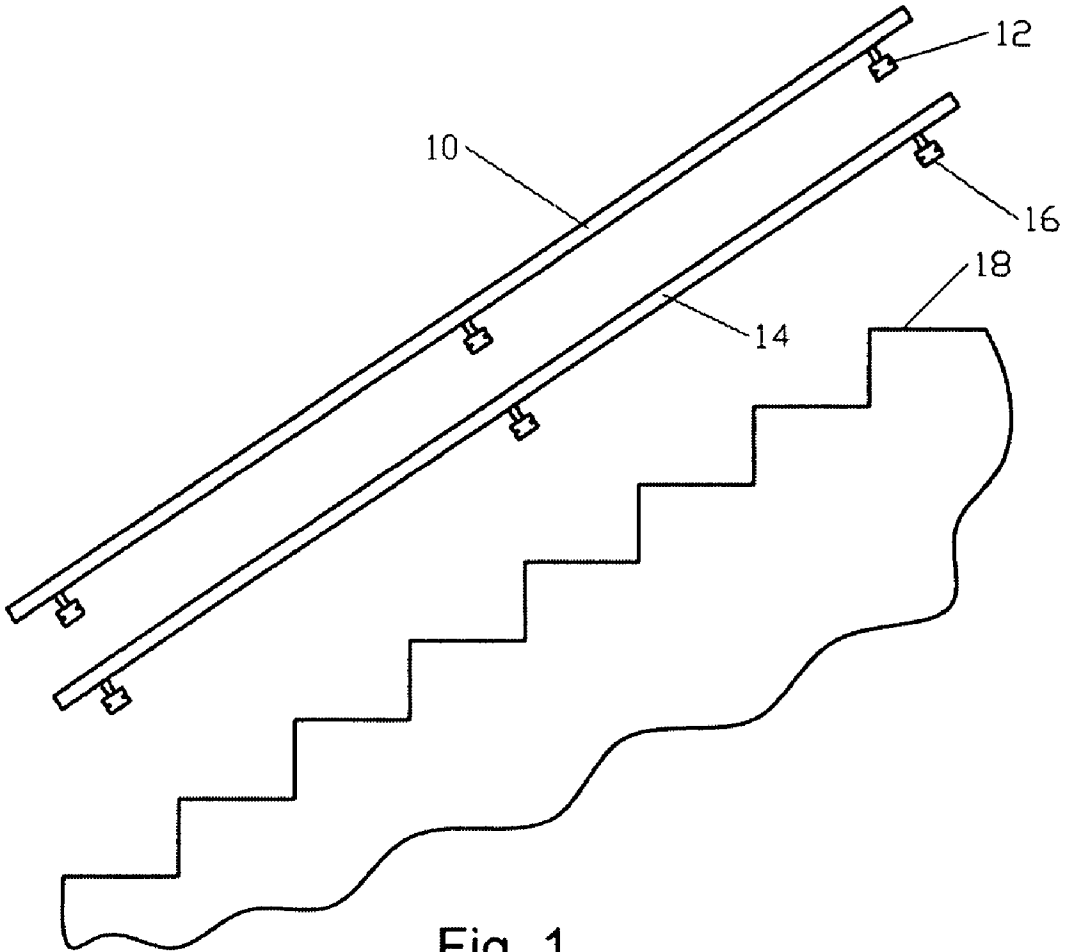
FIG. 1 shows the existing art.

FIG. 1 shows the existing art for a toddler stair safety system. The conventional railing 10 is attached to the wall with mounting brackets 12. A toddler railing 14 is shown at a lower height attached to a wall with brackets 16 to allow a toddler to more safely go up and down stairs 18. Such a system is very bulky to ship and transport, requires the use of a tool, and causes damage to a wall.

Figure 2:
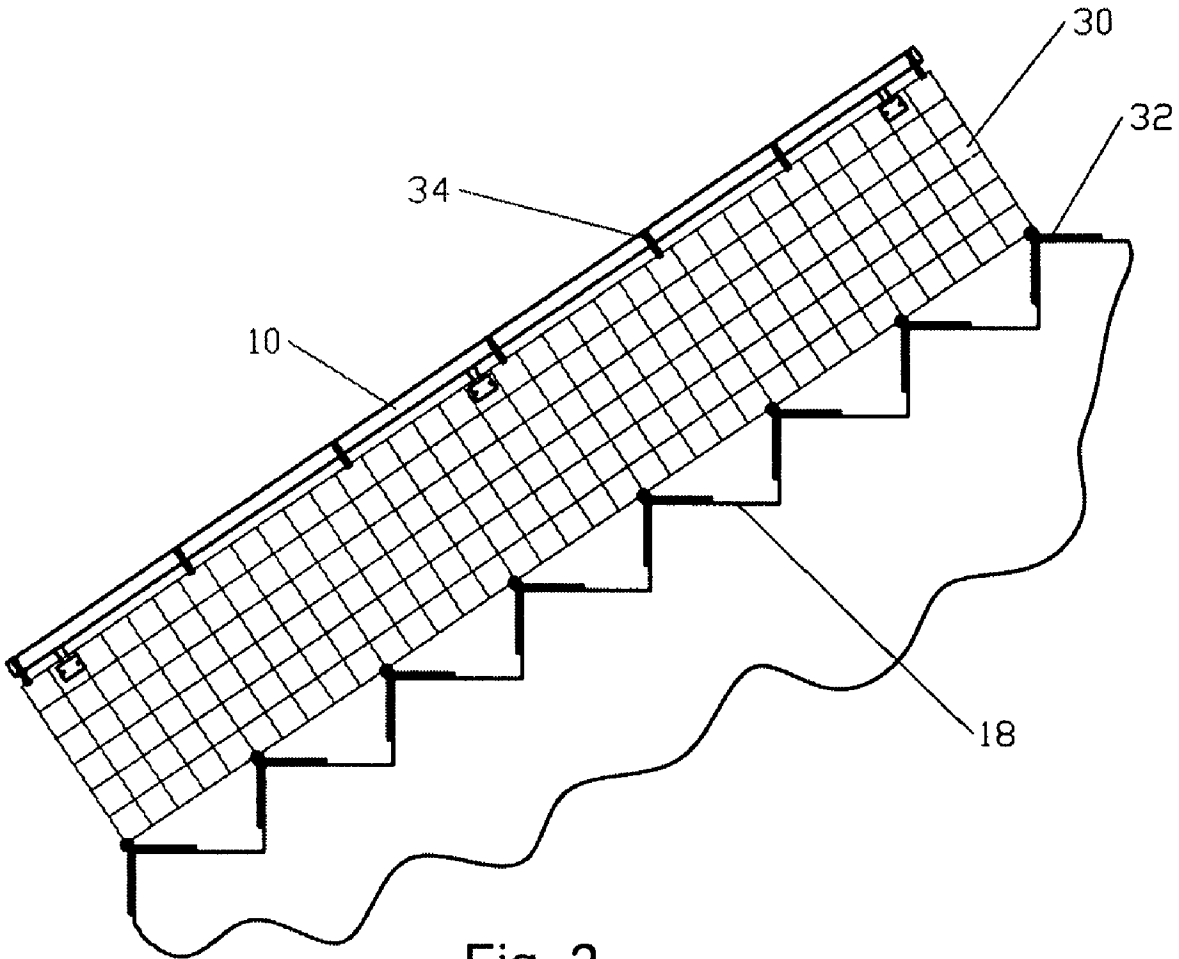
FIG. 2 shows the basic system in use.

FIG. 2 shows the system of the instant invention in application. The existing railing 10 is shown over the existing stairs 18. But, in this case, there is a heavy netting of thick material and a large mesh 30 which is pulled down and attached to stair edge grippers 32 and pulled up and attached to the banister (or railing) 10 by stand-alone fasteners 34.

Attachments 32 and 34 are done on a temporary basis, require no tools, and do no damage to the existing surfaces.

Figure 3:
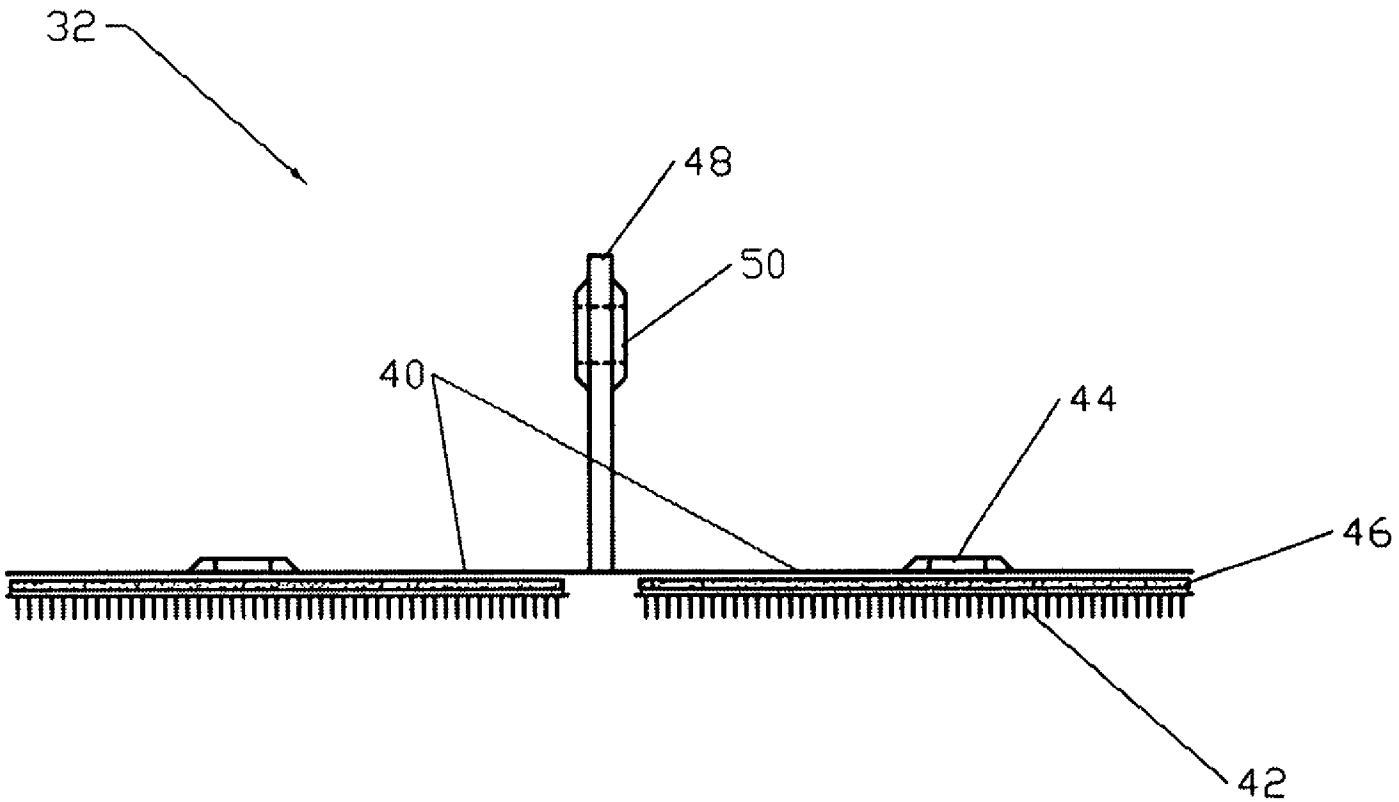
FIG. 3 shows the side view of the stair step gripper.

FIG. 3 shows a side view of the stair edge gripper 32. The thick duck material or nylon strapping 40 runs the full length of the gripper. Attached underneath is the deep-machined hook fastening surface 42, which is attached to the duck or nylon material 40 by adhesive 46. In an alternative embodiment grommets 44 on each side of the fastener are inserted in the material 40 to allow for the use of a wood screw to attach. This would be used for a case where the stairs are not carpeted. The grommet 50 is mounted just beneath the fold 48 of the main body material. A preferred deep-machined hook fastener is the MVA8 available from the Velcro Fastening Systems of Manchester, N.H. An alternative deep-machined hook surface is the Velcro "extreme" fastener surface strip.

The length of each wing of the stair edge gripper 32 is preferably between 2-4 inches but lengths of 1-10 inches are usable.

Figure 4:
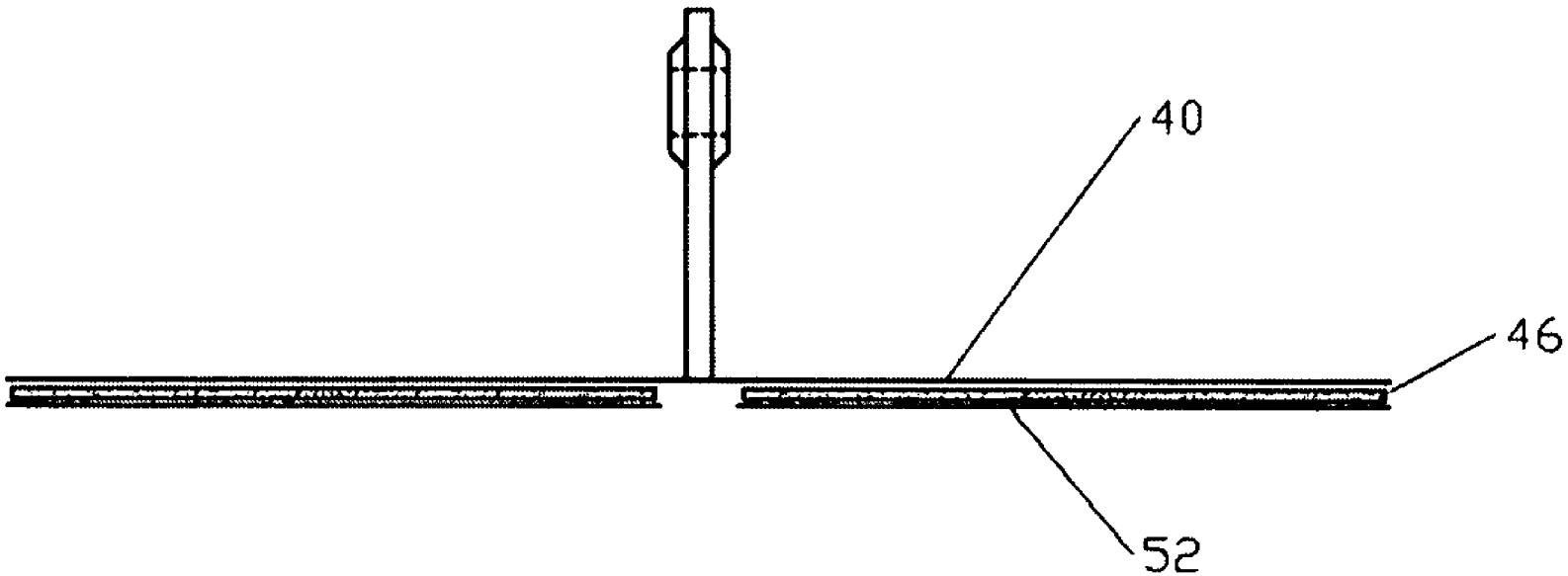
FIG. 4 shows another side view of the stair step gripper.

FIG. 4 shows an alternative embodiment to the stair edge gripper, which does not require carpeted stairs. In this case the main body material has a double-sided adhesive 46 attached to it and protected for shipping by release liner 52. The grommet assembly is as before.

Figure 5:
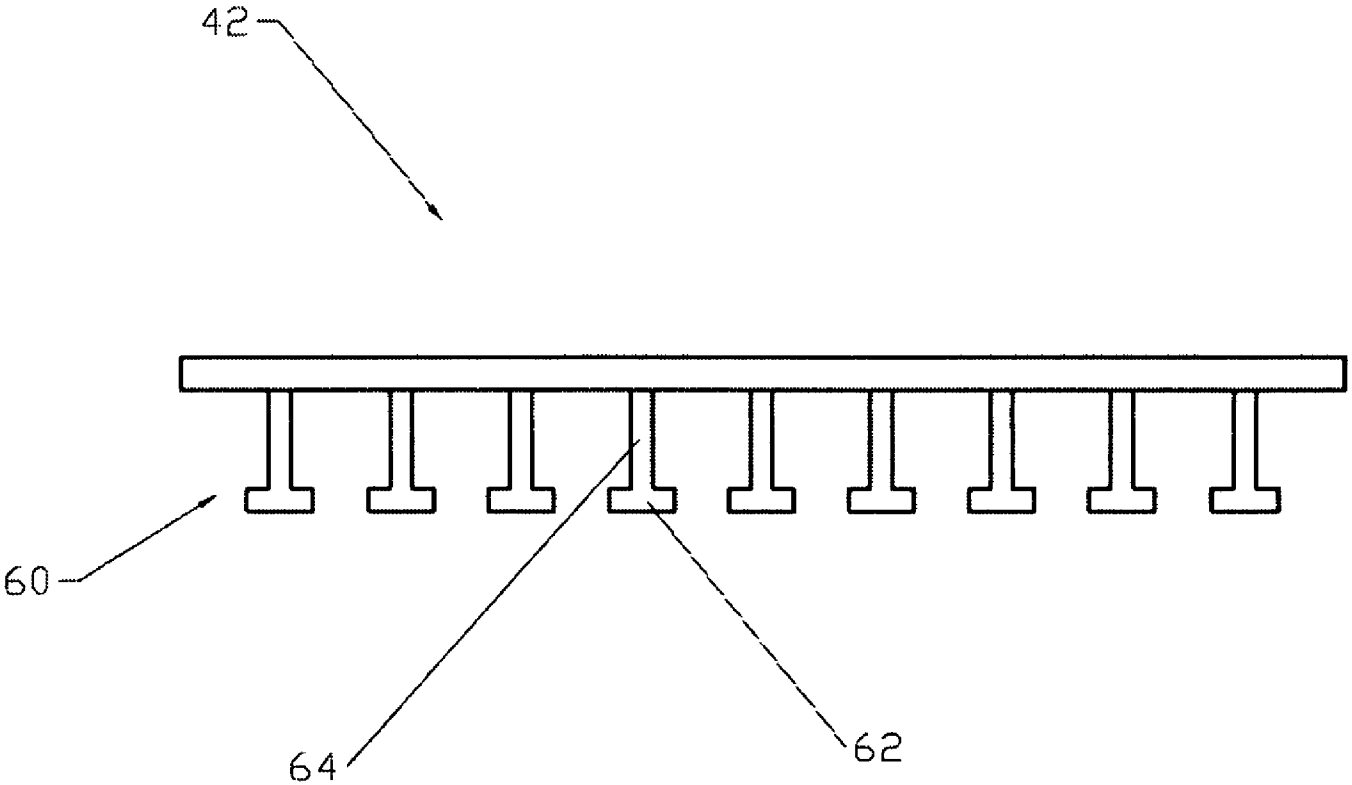
FIG. 5 shows the details of the deep-machined hook-gripping surface.

FIG. 5 is a side view of the machined hook material 42. Note that each hook 60 is in the shape of an upside down "T". The width 62 of the T section is approximately 20% of the height 64. However, fractions between 10% and 40% will also work. The height of the T is preferably at least 1 mm and preferably about 2 mm. Alternatively heights between about 0.7 mm and 5 mm will work.

Figure 6:
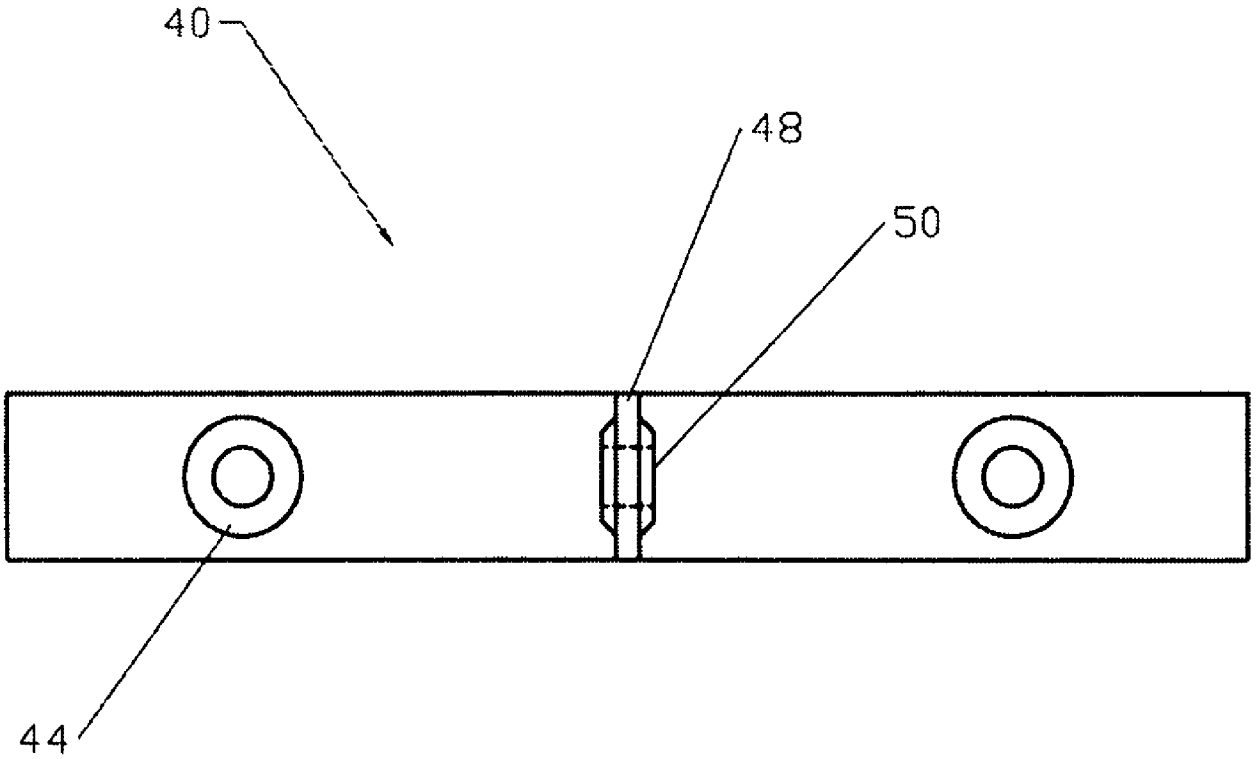
FIG. 6 shows the top view of a stair edge gripper.

FIG. 6 gives a top view of the stair edge connector 40. Here we see the fold 48 with the main grommet 50 installed in it. Also see the alternative grommets 44 in the top surface. The width of the wings are preferably in the range of 0.6-1.5 inches but widths in the range of 0.4-2.5 inches will also work.

Figure 7:
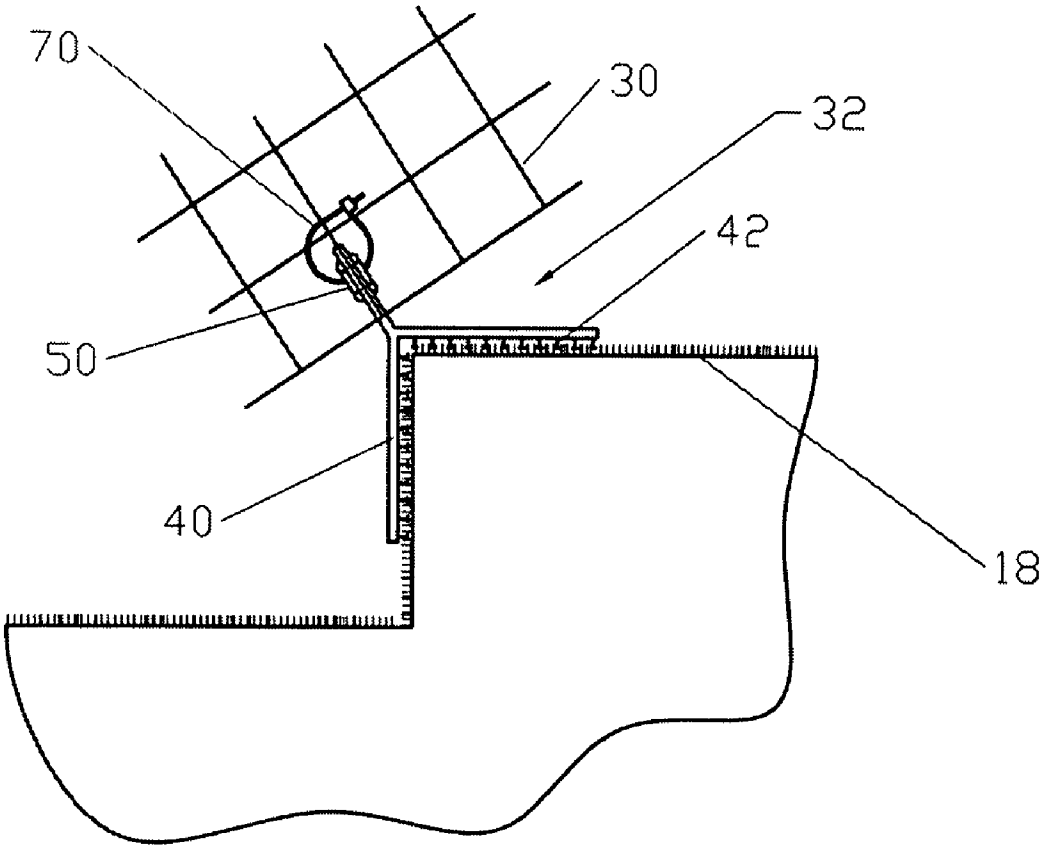
FIG. 7 shows a side view of the mesh net being attached to the stair step edge with the stair edge gripper.

FIG. 7 shows the stair edge gripper 32 being attached to the one-stair edge steps 18 and pulling down the net 30. Here the vertical force of the net is transferred through a hook and loop fastener 70 through the grommet 50 and down through the duck material 40 and into the deep machined hook fastening surface 42. That will maintain great strength in this vertical tension. The horizontal part of the stair edge gripper 32 with this primary body material 40 and deep machined hook 42 is not in tension in this case and will only go into tension when the toddler hand pulls the net in a horizontal direction or because of pre-stresses when the net was first installed. A suitable material for fastener 70 is the Ultra Mate® brand self-fastener available from Velcro USA of Manchester, N.H. preferably in a ⅜" width.

Figure 8:
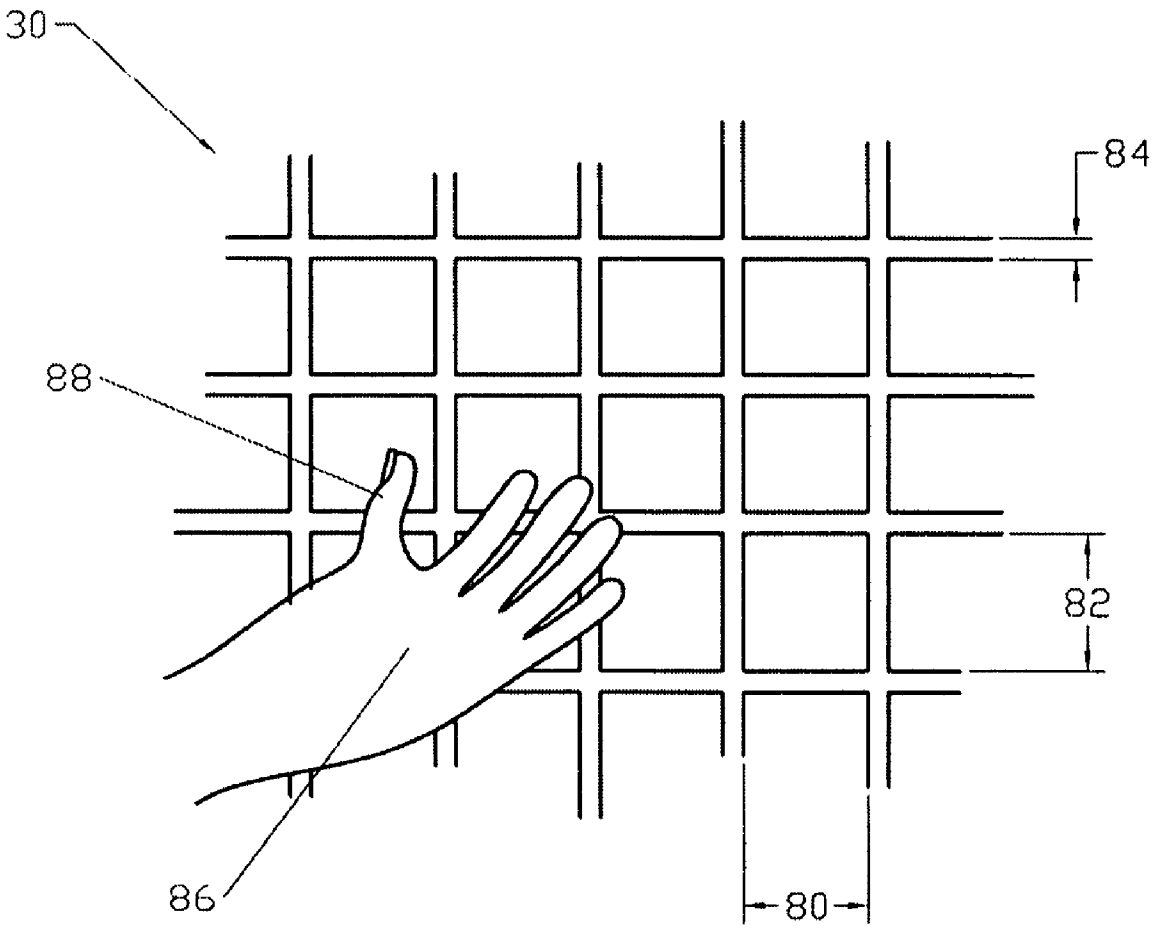
FIG. 8 shows the large mesh.

FIG. 8 shows the net 30 in use. There is an optimal width and height of the mesh. Width 80 and height 82, is about 38 mm or about 1.5". This is enough room for a toddler's hand 86 to grip across the net. Yet, it is not so large to allow major distortion with the child pulling on the net. Secondly it is large enough so there is no risk of having a child's finger getting caught in the net. The dimension of about 1" to 2" is optimal for this mesh. However, dimensions of ¾ to about 3 inches could be used.

These dimensions are critical to roper operation of the invention. Note that the netting "barriers" such as the one by Langan have ¼-½ inch weave (col 2:46) which would not allow even a toddler to get a handgrip or even multiple fingers in the net.

The diameter of the cord in the mesh is also important. If this is too large it will add excessive weight and bulk to the netting as well as fill up too much of the space in the mesh. If it is too small it will tend to cut the child's hand and be uncomfortable and thus discourage its usage. The optimal cord diameter for the net is 3 mm. However, diameters between 2 mm and 4 mm are very usable, and diameters between 1 mm and 5 mm would function for this usage. Diameter 84 is about 3 mm. The child's thumb 88 is also shown going over a horizontal cord of the net. The meshes need not be square but may be triangular, rectangular, hexagonal, or of any irregular polygonal shape.

Figure 9:
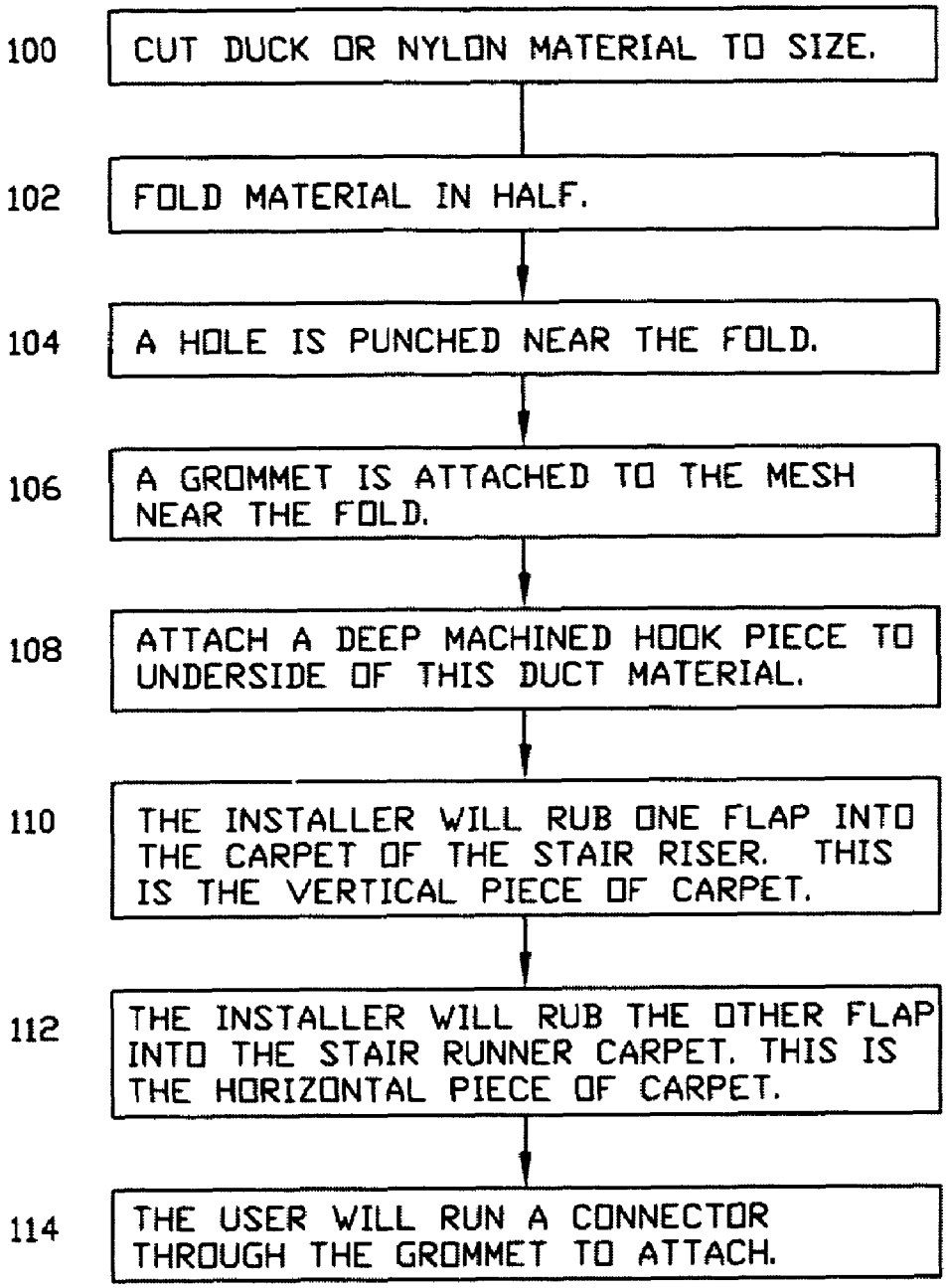
FIG. 9 shows the method of making and using the stair step gripper.

FIG. 9 shows the method of making and using the stair edge gripper.

First in step 100 the duck or nylon material is cut to shape and size.

Then in step 102 it is folded in half.

In step 104 a hole is punched near the fold.

In step 106 a grommet is attached to the mesh near the fold.

In step 108 a deep-machined hook piece is attached to the underside of this duck material.

In step 110 the installer will rub one flap into the vertical piece of carpet of the stair step.

In step 112 the installer will rub the other flap into the horizontal piece of carpet of the stair step In step 114 the user will run a connector through the grommet to attach to the object of attachment.

Figure 10:
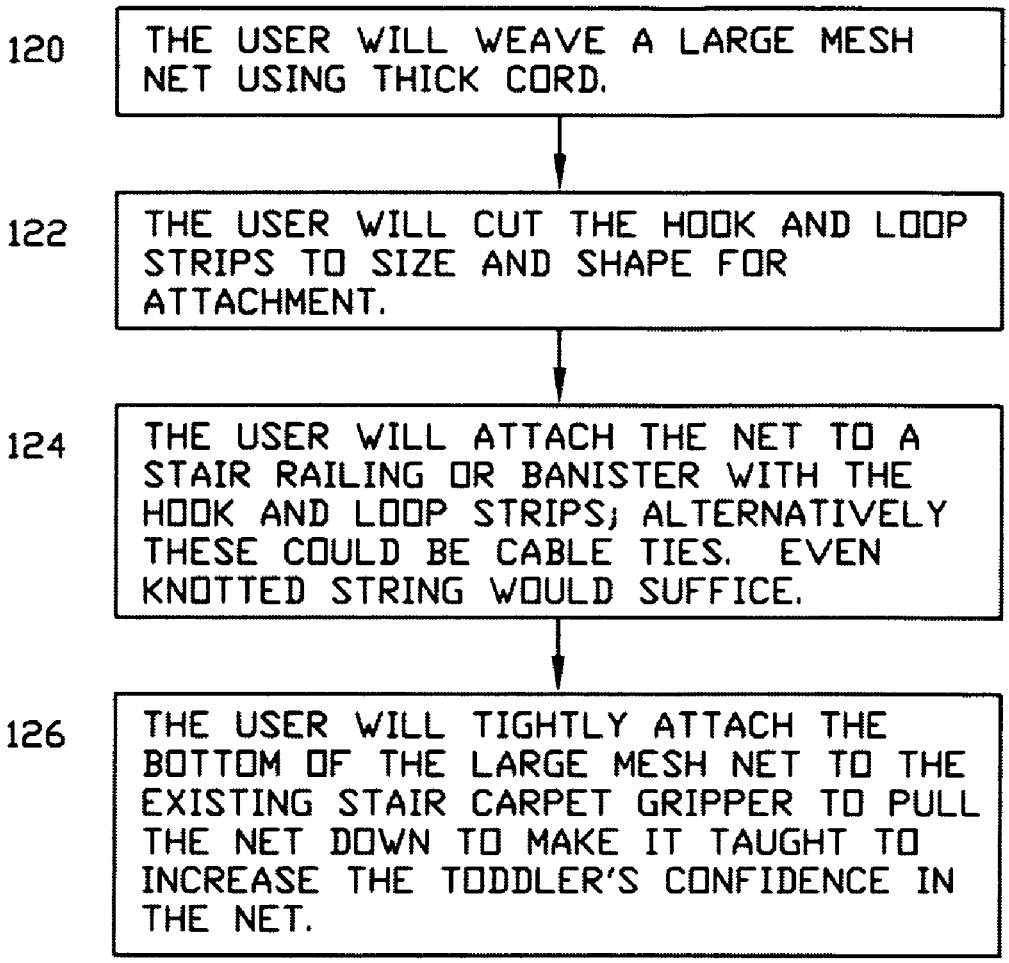
FIG. 10 shows the method of making and using the wall stair safety system.

FIG. 10 gives a method of manufacturing and using the stair stepper system of the invention.

In step 120 the user will weave a large mesh net using thick cord.

In step 122 the user will cut the hook and loop strips to size and shape for attachment.

In step 124 the user will attach the net to a stair railing or banister with the hook and loop strips; alternatively these could be cable ties. Even knotted string would suffice.

In step 126 the user will tightly attach the bottom of the large mesh net to the existing stair carpet gripper to pull the net down to make it taut to increase the toddler's confidence in the net.

Figure 11:
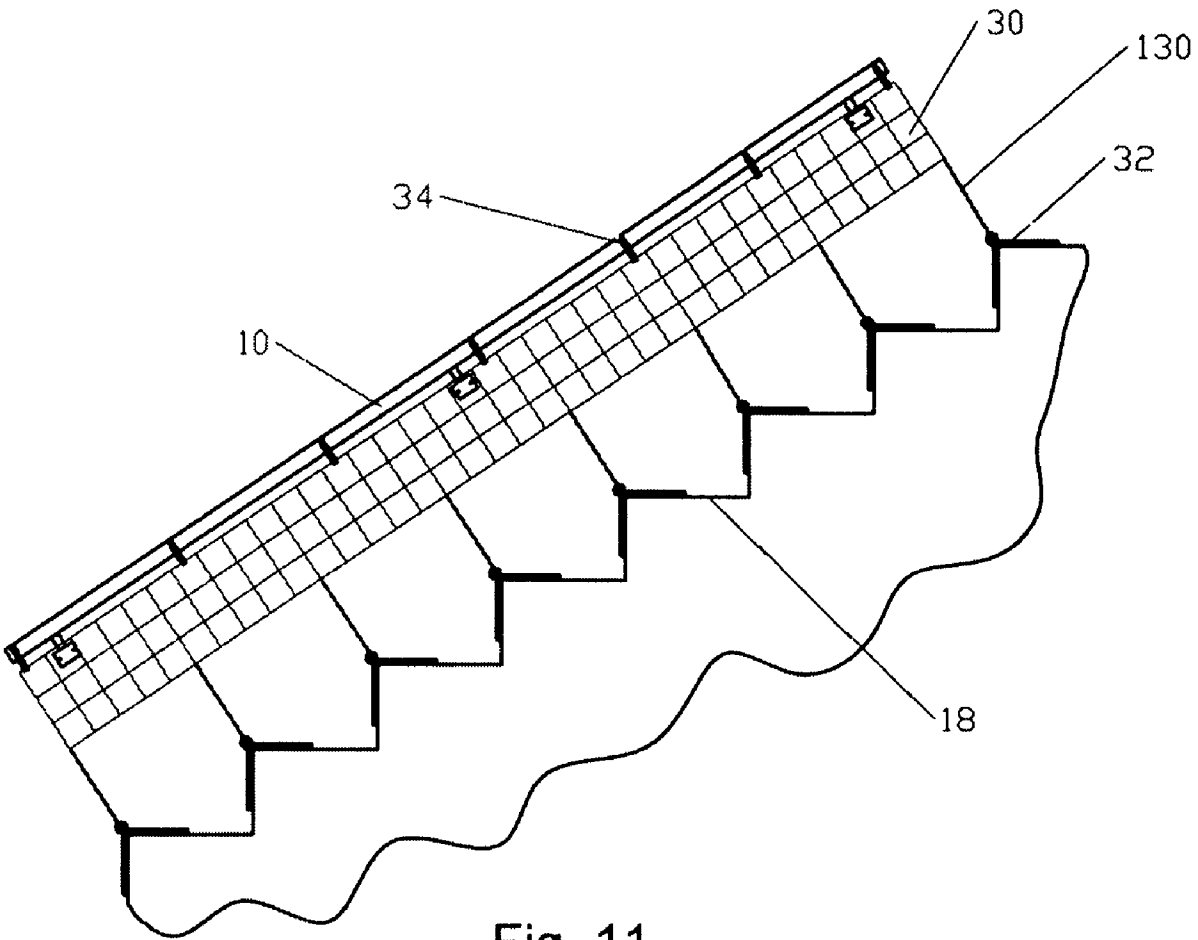
FIG. 11 shows the system using the partial net embodiment.

FIG. 11 shows the system of the preferred partial net embodiment in application. The existing railing 10 is shown over the existing stairs 18 as in FIG. 2. But, in this case, the heavy netting of thick material and large mesh 30 does not reach all of the way to the steps but rather stops about 30-50% of the way down to the steps. Having the net go down as far as 20-60% of the way would also be suitable. The net is then pulled down by straps 130 and attached to stair edge grippers 32 and pulled up and attached to the banister 10 by stand-alone fasteners 34. As before, attachments 32 and 34 are done on a temporary basis, require no tools, and do no damage to the existing surfaces. Most importantly, this allows no toe-hold for toddlers to climb over the railing to face a more serious fall.

This 30-50% of the typical railing height (36 inches by building code) gives a net height of 10.8-18 inches. None of this is anticipated by net barriers such as that of Langan who teaches a nominal range of 36-42 inches with a broad range of 26-26 inches (col 3:47-49). The 20-60% range for the net depth in the instant invention translates to a 7.2-21.6 inch depth. The resulting gap would be in the range of 14.4-28.8 inches.

Figure 12:
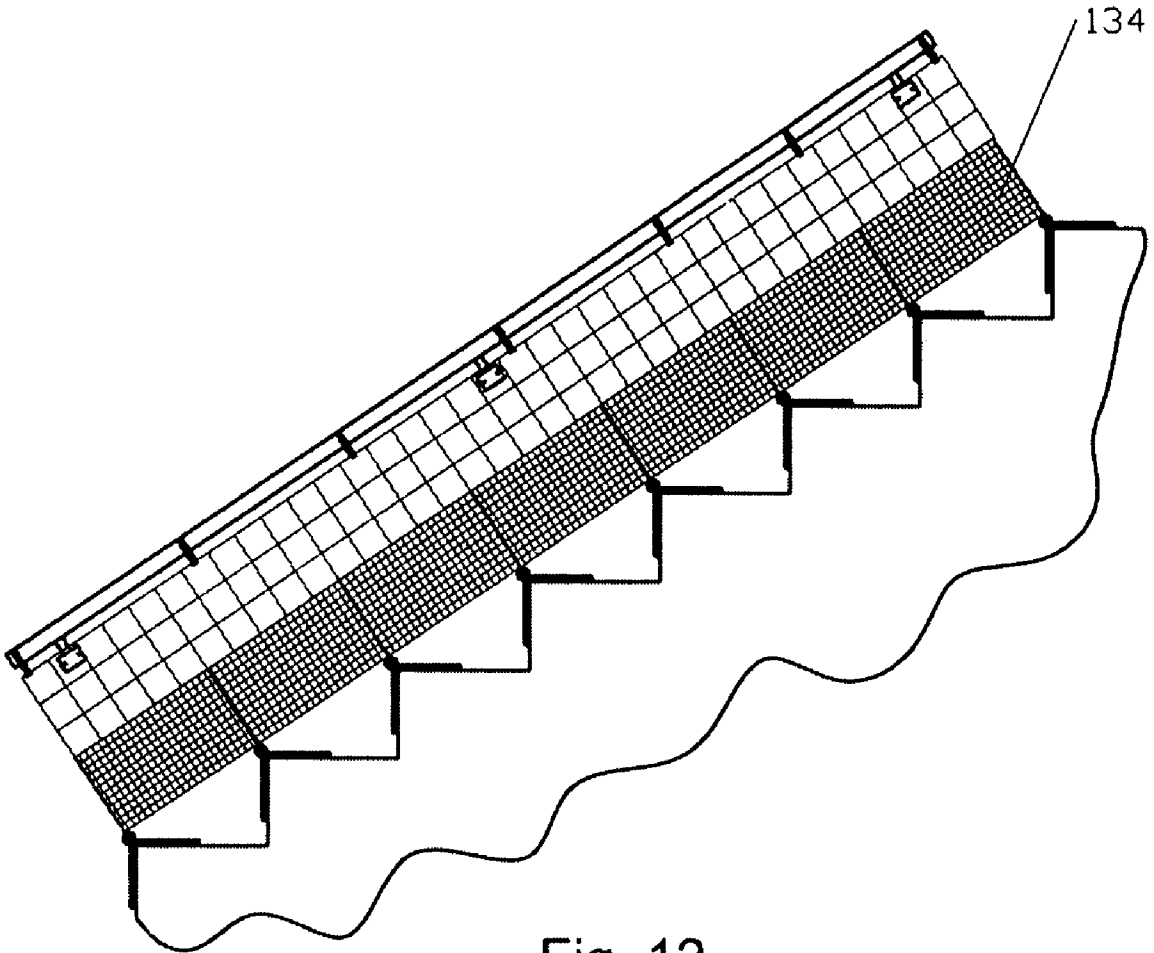
FIG. 12 shows the system using the hybrid net embodiment.
Figure 13:
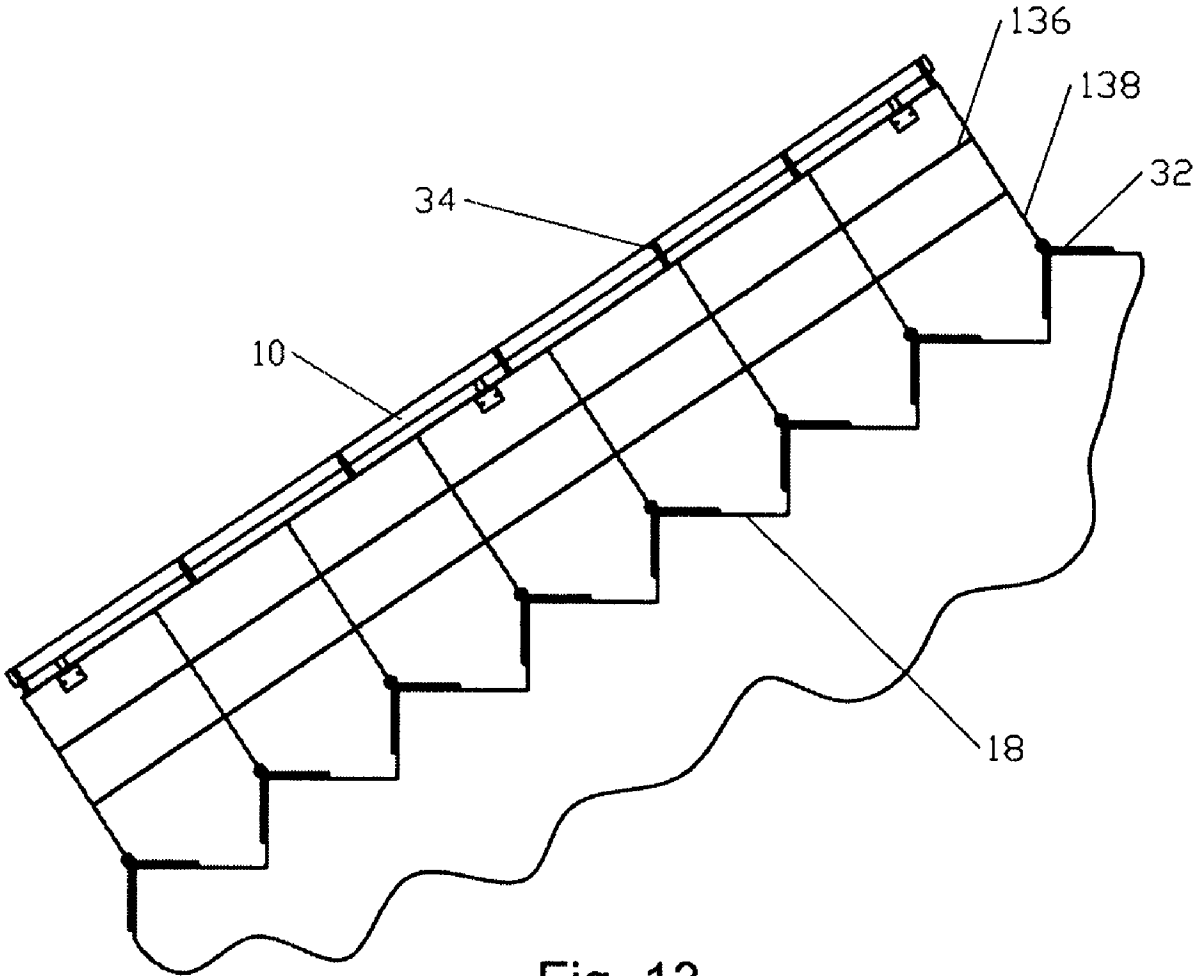
FIG. 13 shows the system using other elements.

FIG. 12 shows the system of the hybrid net embodiment in application. The existing railing 10 is shown over the existing stairs 18 as in FIG. 2. But, in this case, the heavy netting of thick material and large mesh 30 does not reach all of the way to the steps but rather stops about 30-50% of the way down to the steps. Having the net go down as far as 20-60% of the way would also be suitable. Below the large mesh net is a fine mesh net. The fine mesh net will prevent children from falling through the balusters as before. However, the fine net will not catch toes or shoes and thus will be less likely to allow tripping. Suitable mesh sizes for the fine mesh net are between 0.25 and 0.5 inches. But, a broader range of fine mesh sizes is also functional including 0.125 and 1.0 inch spacings. And, the horizontal and vertical spacings do not have to be equal. The figure shows the large mesh net connected directly to the fine mesh net but there could be a gap between them. The fine mesh net is then pulled down and attached to stair edge grippers 32. The large mesh net is pulled up and attached to the banister 10 by stand-alone fasteners 34. As before, attachments 32 and 34 are done on a temporary basis, require no tools, and do no damage to the existing surfaces. FIG. 13 shows the system using elements 136 and 138.

We claim:

1. A stair safety system for toddlers comprising:

a stair railing and stairs;

a mesh net with a first edge and a second edge, the mesh net being constructed and arranged to be grasped by a toddler;

a plurality of stair grippers, wherein each of the plurality of stair grippers comprises a vertical engagement surface having at least one of double sided adhesive, screws and deep machined hooks; the vertical engagement surface engaging a vertical stair surface of the stairs; and a horizontal engagement surface having at least one of double sided adhesive, screws and deep machined hooks; the horizontal engagement surface engaging a horizontal stair surface of the stairs; and first connecters having at least one of cable ties and hook and loop material, each first connecter engaging the first edge and the stair railing; and second connecters, each second connecter engaging the second edge and at least one of the plurality of stair grippers.

2. The system of claim 1 in which the net has a cord diameter between about 1 and 4 mm.

3. The system of claim 1, wherein the mesh net defines a plurality of openings, and wherein at least some of the openings have a dimension between about 1 and 2 inches.

4. The system of claim 1 in which the net has a cord diameter of about 3 mm.

5. The system of claim 1 in which the net has a cord diameter between 1-5 mm.

6. The system of claim 1, wherein the mesh net defines a plurality of openings, and wherein at least some of the openings have a dimension of about 1.5 inches.

7. The system of claim 1, wherein the mesh net defines a plurality of openings, and wherein at least some of the openings have a dimension between about 1-2 inches.

8. The system of claim 1, wherein the mesh net defines a plurality of openings, and wherein at least some of the openings have a dimension between about 0.75-3 inches.

9. The system of claim 1, wherein the deep-machined hooks have depths between about 1-2 mm.

10. The system of claim 1, wherein the deep-machined hooks have depths between about 0.7-5 mm.

* * * * *